United States Patent [19]

Hakes et al.

[11] 4,328,994

[45] May 11, 1982

[54] MINING APPARATUS AND METHOD

[75] Inventors: Gary A. Hakes, Hopewell, N.J.; William E. McCracken, Pittsburgh, Pa.

[73] Assignee: Lee Norse Company, Pittsburgh, Pa.

[21] Appl. No.: 145,847

[22] Filed: May 1, 1980

[51] Int. Cl.[3] ..... E21D 9/10; E21D 15/58

[52] U.S. Cl. ..... 299/11; 299/33

[58] Field of Search ..... 299/11, 31, 33

[56] References Cited

U.S. PATENT DOCUMENTS 2,772,871 12/1956 Caine ..... 299/33

3,939,958 2/1976 Pyles ..... 299/11 X 3,995,905 12/1976 Jamison ..... 299/11

*Primary Examiner*—Ernest R. Purser

*Attorney, Agent, or Firm*—Joseph T. Harcarik

[57] ABSTRACT

A mining apparatus and method for dislodging material from a mine face. The dislodged material is transported from the front to the rear of the mine for further handling. The apparatus has a lifting mechanism for raising cross beams to the roof of the mine wherein beam jacks are permitted to engage the cross beams to provide support to the mine roof. The temporary roof support permits advancement of miner as dislodged material is removed.

13 Claims, 4 Drawing Figures

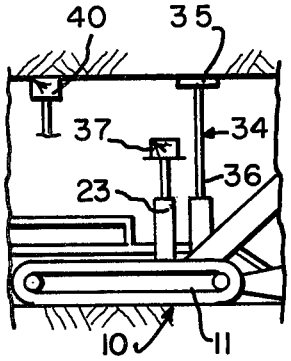
FIG. 4
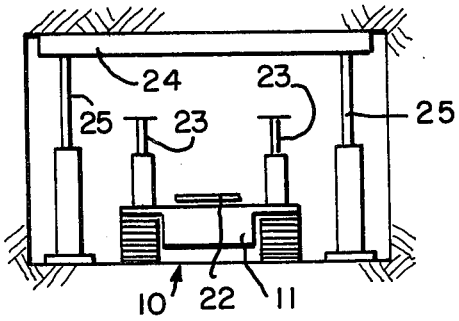
FIG. 2
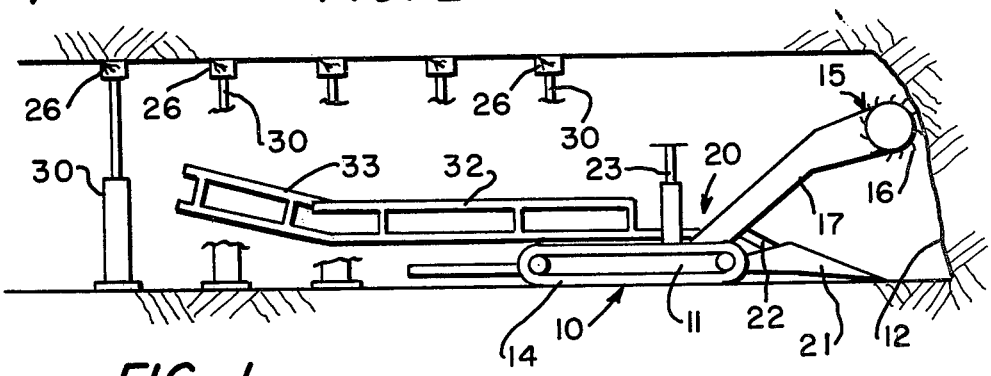
FIG. 1
FIG. 3
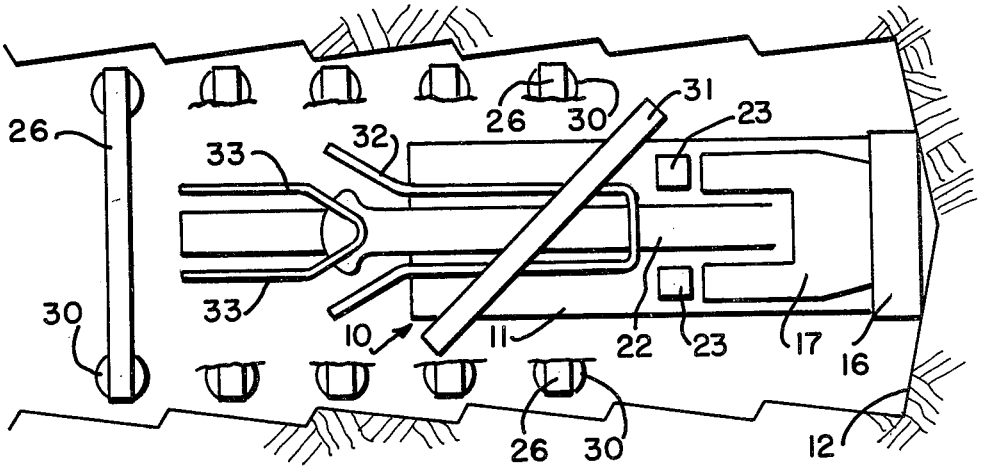

MINING APPARATUS AND METHOD

REFERENCE TO RELATED APPLICATIONS

This application is related to co-pending application "A Mining and Bolting Method and Apparatus" Ser. No. 145,686 by William Edward McCracken and Gary Arthur Hakes which application is filed concurrently with this application and is herein incorporated by reference.

BACKGROUND OF THE INVENTION

1. Field of the Invention

This invention pertains to an apparatus and method for dislodging material from a mine face, and more particularly to a dislodging apparatus and method wherein a temporary roof support is installed allowing the forward advance of the apparatus and of the temporary roof support.

2. Description of the Prior Art

In the past the material has been removed from a mine by placing a mining apparatus in the vicinity of the mine face and removing material from the mine face to a depth of approximately ten to twenty feet. The miner is then removed from the mine face and a roof support system is installed in the excavated portion of the mine. After a roof support system has been installed, the miner is then brought back to the mine face and the mining operation continued. The removing and bring back of the miner to the mine face is a cumbersome and time consuming operation often causing damage to the equipment. A more efficient mining operation has been sought.

In U.S. Pat. No. 3,995,905, an apparatus and method is disclosed which attempts to avoid this problem. A series of roof beam supports are hydraulically raised from a mining apparatus which temporarily supports the roof as material is dislodged from the mine face. When the miner is to be advanced, the series of temporary roof supports are lowered and the miner is advanced. After the miner has advanced, the series of temporary roof supports are lifted and resupport the roof. The roof of the mine, however, is subjected to the cycle of support, nonsupport and resupport. This cycling of the mine roof is detrimental to the structure of the mine roof causing weakness of the roof.

The apparatus, furthermore, requires an extensive amount of hydraulic lifting equipment making the apparatus cumbersome, difficult to maneauver and prone to mechanical failure.

More recently in U.S. Pat. No. 4,143,991, an apparatus is described for providing a temporary support system over the miner which is not attached to the miner. This Patent, however, as with the above mentioned Patent, 3,995,905, is also cumbersome and has the undesirable affect of cycling the roof.

A simplified means for providing a temporary roof support system which does not cycle the roof has been sought.

SUMMARY OF THE INVENTION

This invention relates to a mining apparatus and method. The mining apparatus has a body with a ground engaging mechanism enabling movement of the apparatus through a mine. On the body is a mechanism for dislodging materials from a mine face and a means for transporting the dislodged materials from a mine face and a means for transporting the dislodged material to the rear of the apparatus for further handling. Further provided on the apparatus is a mechanism for raising cross beams to the roof of a mine wherein beam jacks are permitted to engage the cross beams to provide support to the mine roof.

According to the present invention, a temporary roof support system is provided by the lifting mechanism raising a cross beam to the roof of the mine in a manner allowing beam jacks to support the cross beam and hence support the roof. The lifting mechanism is then lowered. As the mining apparatus advances, the cross beams installed remain in position until a permanent roof support is installed. This is accomplished by bringing additional cross beams forward and then raising them into place, rather than moving a series of beams forward in tandum. Cycling of the roof is thus eliminated.

Furthermore, since each beam is individually installed, the machine has great flexability which enables it to maneauver corners easily. In addition, only one set of mechanical lifting mechanism is involved, insuring more reliability.

BRIEF DESCRIPTION OF THE DRAWINGS

FIG. 1 is a schematic side view illustration of the mining apparatus in a mine entry showing temporary cross beam supports which have been installed.

FIG. 2 is a schematic cross sectional illustration of a mine entry showing a cross beam, lifting mechanism and beam jacks.

FIG. 3 is a schematic top view illustration of the mining apparatus in the mine entry.

FIG. 4 is a schematic side view illustration of the mining apparatus in the mine entry.

DESCRIPTION OF THE PREFERRED EMBODIMENT

Referring to the drawings, there is shown a mining apparatus generally designated as 10 having a body 11. The body has a forward section facing a mine face 12 and a rear section positioned away from mine face 12. A ground engaging means 14 is provided for maneauvering the mining apparatus throughout the mine. Ground engaging, 14 means includes conventional means such as rubberized wheels, metal wheels, rails and caterpillar moving mechanisms. A material dislodging means 15 is provided which is capable of dislodging material from mine face 12. Mining dislodging means 15 may be comprised of a cutting mechanism 16 and a support system 17 connecting cutting mechanism 16 to body 11. Cutting mechanism 16 includes a conventional type such as pick studded rotary drums and shearing drum. After the material has been dislodged from mine face 12 a conveying means 20 conveys the dislodged material from the forward section to the rear section. Conveying means 20 includes conventional means such as belt and bucket conveyors. In FIG. 1 conveying means 20 is shown as gather head 21 which collects dislodged material and a conveyor belt 22 which transports the dislodged material rearward for further handling.

To install a temporary roof support, a lifting means 23 is provided on body 11 for lifting cross beams 24, as shown in FIG. 2, to the roof of the mine. Lifting means 23 includes conventional lifting means such as a hydraulic, mechanical and jacking lifting devices. Cross beams 24 include conventional types such as wood, metal and plastic. Once cross beam 24 is raised to the roof by lifting means 23, beam jacks 25 are placed in support of cross beam 24 and lifting means 23 is lowered. Cross beam 24 supported by the beam jacks 25 thus provide temporary support to the mine roof.

FIGS. 1 and 3 show a series of cross beams 26 and beam jacks 30 which provide a temporary support to the mine roof. As mining apparatus 10 dislodges material from mine face 12, the depth of the mine entry is increased. The miner may then be advanced forward to a new mine face. It thus becomes necessary to advance the temporary mine support over mining apparatus 10 in order to continue the advance of mining apparatus 10. This is accomplished as shown in FIG. 3 by moving an additional beam 31 forward to lifting means 23. According to the present invention, bringing additional cross beam 31 forward allows cross beams 26 to remain in a fixed position until a permanent roof support is installed. Cycling the support load on the roof is thus prevented.

In another embodiment of this invention, a means is provided for supporting additional cross beam 31 as it is being brought forward. The supporting means includes conventional means such as rail and platform supports and the supporting means may be of one or more members. FIGS. 1 and 3 illustrate the supporting means as comprised of a first rail 32 and a second rail 33. The rails may be of conventional material such as metal, wood or plastic. The two rail supports allows for movement, such as side to side and up and down, of each rail to the other. This movement allows for similar movement of conveyor belt 22 and thus provides flexibility in the movement of mining apparatus 10.

In an additional embodiment of this invention, a temporary roof support means 34 is provided in front of lifting means 23 as shown in FIG. 4. Temporary roof support means 34 may be comprised of a cross support 35 and a cross support lifting mechanism 36. Cross support 35 includes conventional structures such as wood, metal and plastic. Cross support lifting mechanism 36 includes conventional lifting mechanisms such as hydraulic, mechanical and jacking lifting mechanisms. In this embodiment, temporary roof support 34 is raised into support prior to cross beam 37 being placed on lifting means 23. Thus, any person placing cross beam 37 onto lifting mechanism 23 performs the operation under a supported roof. Cross beam 37 is then raised into place next to cross support 35. Cross support 35 may then be lowered.

In still another embodiment of this invention, cross beam 37 may be manually placed on lifting means 23 without temporary roof support 34 and still have the persons handling cross beam 37 under a supported roof. This is done by having the person placing cross beam 37 on lifting mechanism 23 stand under cross beam 40. Lifting means 23 is then tilted back towards the person under cross beam 40 so that the person may place cross beam 37 onto lifting means 23 without moving forward of cross beam 40. Alternatively, a person may stand under cross beam 40 and slide or extend cross beam 37 onto lifting means 23 with rods, extension grips and the like.

We claim:

1. A mining apparatus comprising:

a. a body having a forward section and a rear section;

b. a ground engaging means for enabling movement of the body through a mine;

c. a mining means for dislodging material from a mine face;

d. a conveying means for transporting the dislodged material from the forward section to the rear section;

e. a lifting means for raising cross beams to the roof of a mine wherein beam jacks are permitted to engage the cross beams to provide support to the mine roof; and f. a cross beam supporting means for enabling movement by manual labor of cross beams from the rear section to the forward section.

2. A mining apparatus according to claim 1 wherein the ground engaging means is a caterpillar moving mechanism.

3. A mining apparatus according to claim 1 wherein the mining means is a pick studded rotary drum.

4. A mining apparatus according to claim 1 wherein the conveying means comprises a gathering head and a conveyor belt.

5. A mining apparatus according to claim 1 wherein the lifting means is a hydraulic lifting mechanism.

6. A mining apparatus according to claim 1 wherein the cross beam supporting means comprises a first rail and a second rail.

7. A mining apparatus according to claim 1 further comprising a temporary roof support.

8. A method of mining wherein a mining apparatus in a mine entry is positioned under a temporary roof support and near a mine face comprising:

a. dislodging material from the mine face with the mining apparatus wherein the mine face is advanced;

b. transporting dislodged material from the mine face;

c. transporting a cross beam by manual means to a lifting means on the mining apparatus wherein the cross beam is supported by a support means affixed to the mining apparatus as the cross beam is transported to the lifting means;

d. lifting the cross beam to the mine roof with the lifting means;

e. supporting the cross beam with beam jacks wherein the lifting means is lowered and the temporary roof support is advanced;

f. advancing the mining apparatus to the advanced mine face; and g. repeating steps a, b, c, d, e and f.

9. A method of mining according to claim 8 wherein the material is dislodged from the mine face by a pick studded rotary drum.

10. A method of mining according to claim 8 wherein the dislodged material is transported from the mine face by a gather head and a conveyor belt.

11. A method of mining according to claim 8 wherein the lifting means is a hydraulic lifting mechanism.

12. A method of mining according to claim 8 wherein the mining apparatus is advanced by a caterpillar moving mechanism.

13. A method of mining according to claim 8 wherein the support means comprises a first rail and a second rail.

* * * * *